US012013188B2

(12) United States Patent
Numata et al.

(10) Patent No.: US 12,013,188 B2
(45) Date of Patent: Jun. 18, 2024

(54) SHELL-AND-PLATE TYPE HEAT EXCHANGER

(71) Applicant: DAIKIN INDUSTRIES, LTD., Osaka (JP)

(72) Inventors: Mitsuharu Numata, Osaka (JP); Yutaka Shibata, Osaka (JP); Kou Terai, Osaka (JP); Hirokazu Fujino, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/860,339

(22) Filed: Jul. 8, 2022

(65) Prior Publication Data

US 2022/0341674 A1 Oct. 27, 2022

Related U.S. Application Data

(63) Continuation of application No. PCT/JP2021/000987, filed on Jan. 14, 2021.

(30) Foreign Application Priority Data

Jan. 14, 2020 (JP) ..... 2020-003833

(51) Int. Cl.
*F28D 9/00* (2006.01)
*F28F 3/08* (2006.01)
*F28D 21/00* (2006.01)

(52) U.S. Cl.
CPC ..... *F28D 9/0006* (2013.01); *F28D 9/0043* (2013.01); *F28F 3/08* (2013.01);
(Continued)

(58) Field of Classification Search
CPC ..... F28F 9/001; F28F 9/0273; F28F 13/06; F28F 13/08; F28D 9/0006; F28D 21/0017;
(Continued)

(56) References Cited

U.S. PATENT DOCUMENTS 3,371,709 A * 3/1968 Curt ..... F28D 9/0031 165/165
6,918,433 B2 * 7/2005 Kontu ..... F28D 9/0043 165/145
(Continued)

FOREIGN PATENT DOCUMENTS

JP 06272977 A * 9/1994
JP 08233407 A * 9/1996
(Continued)

OTHER PUBLICATIONS

International Search Report issued in corresponding International Application No. PCT/JP2021/000987 dated Mar. 2, 2021 (2 pages).
(Continued)

*Primary Examiner* — Jianying C Atkisson
*Assistant Examiner* — For K Ling
(74) *Attorney, Agent, or Firm* — Osha Bergman Watanabe & Burton LLP

(57) ABSTRACT

A shell-and-plate heat exchanger includes: a shell that forms an internal space and includes a refrigerant outlet at a top of the shell; and a plate stack disposed in the internal space and that includes heat transfer plates that are stacked and joined together. The shell-and-plate heat exchanger is configured to allow a refrigerant that has flowed into the internal space to evaporate. The refrigerant outlet emits a gas refrigerant out of the internal space through the refrigerant outlet. The plate stack forms: refrigerant channels that communicate with the internal space and through which a refrigerant flows; and
(Continued)

heating medium channels that are blocked from the internal space and through which a heating medium flows. Each of the refrigerant channels is adjacent to an associated one of the heating medium channels with one of the heat transfer plates interposed therebetween.

5 Claims, 7 Drawing Sheets

(52) U.S. Cl.
CPC ..... *F28D 9/005* (2013.01); *F28D 21/00* (2013.01); *F28D 2021/0068* (2013.01)

(58) Field of Classification Search
CPC ..... F28D 1/0308; F28D 1/0325; F28D 5/02; F28D 9/00; F28D 9/0012; F28D 9/0018; F28D 21/0071; F25B 2339/024; F25B 2339/0241; F25B 2339/022; F25B 39/02; F25B 39/022
USPC ..... 165/157
See application file for complete search history.

(56) References Cited

U.S. PATENT DOCUMENTS 8,443,869 B2 * 5/2013 Lavanchy ..... F28F 9/26 165/145
10,066,874 B2 * 9/2018 Pitkänen ..... F28D 9/0006
2005/0039486 A1 * 2/2005 Knoll ..... F28D 9/0043 62/515
2006/0191672 A1 * 8/2006 Stenhede ..... F28F 3/04 165/145
2008/0041096 A1 * 2/2008 Sakashita ..... F28D 21/0017 62/515
2008/0163637 A1 * 7/2008 Ring ..... F28F 9/0265 62/304
2011/0120672 A1 * 5/2011 Ringwaldt ..... F28D 3/00 165/104.14
2016/0161191 A1 6/2016 Bunde-Pedersen
2019/0339016 A1 11/2019 Christensen et al.

FOREIGN PATENT DOCUMENTS

JP 2006-527835 A 12/2006
JP 2011-007467 A 1/2011
JP 2012-057900 A 3/2012
JP 2012057900 A * 3/2012

OTHER PUBLICATIONS

Decision to Grant a Patent issued in corresponding Japanese Application No. 2020-003833 dated Feb. 24, 2021 (5 pages).
English translation of the International Preliminary Report on Patentability issued in corresponding International Application No. PCT/JP2021/000987, dated Jul. 28, 2022 (5 pages).
Extended European search report issued in corresponding European Patent Application No. 21740921.8 dated Dec. 12, 2022 (7 pages).

* cited by examiner

SHELL-AND-PLATE TYPE HEAT EXCHANGER

TECHNICAL FIELD

The present disclosure relates to a shell-and-plate heat exchanger.

BACKGROUND

A shell-and-plate heat exchanger as disclosed by Patent Document 1 has been known. This shell-and-plate heat exchanger includes a plate stack having a plurality of heat transfer plates and a shell housing the plate stack.

The heat exchanger of Patent Document 1 is a flooded evaporator. In this heat exchanger, the plate stack is immersed in a liquid refrigerant stored in the shell. The liquid refrigerant in the shell evaporates when the liquid refrigerant exchanges heat with a heating medium flowing through the plate stack, and flows out of the shell through a refrigerant outlet formed in the top of the shell.

PATENT LITERATURE

Patent Document 1: Japanese Unexamined Patent Publication No. 2006-527835

SUMMARY

A shell-and-plate heat exchanger according to one or more embodiments of the present disclosure including: a shell (20) forming an internal space (21); and a plate stack (40) housed in the internal space (21) of the shell (20) and including a plurality of heat transfer plates (50*a*, 50*b*) stacked and joined together, the shell-and-plate heat exchanger allowing a refrigerant that has flowed into the internal space (21) of the shell (20) to evaporate. A refrigerant outlet (22) for emitting a gas refrigerant out of the internal space (21) is provided at the top of the shell (20). The plate stack (40) forms a plurality of refrigerant channels (41) that communicate with the internal space (21) of the shell (20) and allow a refrigerant to flow through and a plurality of heating medium channels (42) that are blocked from the internal space (21) of the shell (20) and allow a heating medium to flow through, each of the refrigerant channels (41) being adjacent to an associated one of the heating medium channels (42) with the heat transfer plate (50*a*, 50*b*) interposed therebetween. The plate stack (40) is divided into a plurality of heat exchange sections (45*a*, 45*b*) each including two or more of the heat transfer plates (50*a*, 50*b*). A specific heat exchange section (45*b*), which is one of the plurality of heat exchange sections (45*a*, 45*b*) and provides the smallest amount of heat exchange, is arranged closest to the refrigerant outlet (22) among the heat exchange sections (45*a*, 45*b*).

DETAILED DESCRIPTION

Embodiments

Embodiments will be described below. A shell-and-plate heat exchanger (10) (will be hereinafter referred to as a "heat exchanger") of one or more embodiments is a flooded evaporator. The heat exchanger (10) of one or more embodiments is provided in a refrigerant circuit of a refrigeration apparatus that performs a refrigeration cycle, and cools a heating medium with a refrigerant. Examples of the heating medium include water and brine.

Figure 1:
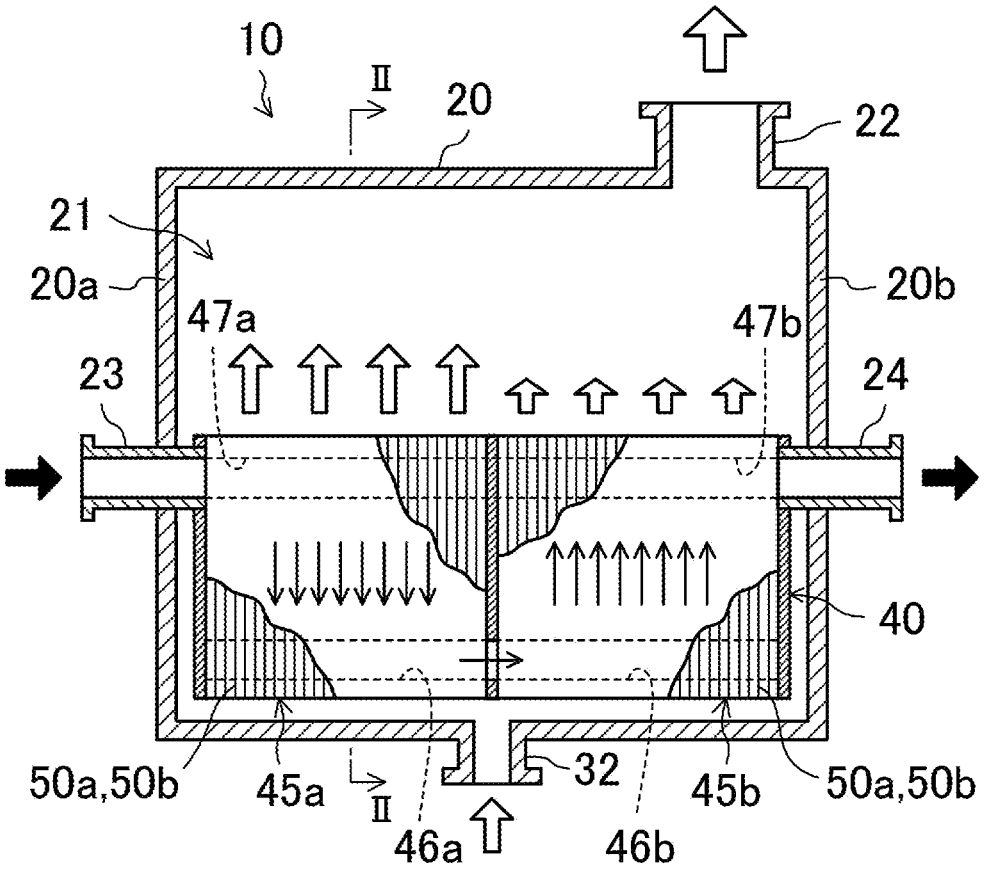
FIG. 1 is a longitudinal cross-sectional view of a shell-and-plate heat exchanger according to one or more embodiments.

As illustrated in FIG. 1, the heat exchanger (10) of one or more embodiments includes a shell (20) and a plate stack (40). The plate stack (40) is housed in an internal space (21) of the shell (20).

—Shell—

The shell (20) is in the shape of a cylinder with both ends closed. The shell (20) is arranged so that its longitudinal direction coincides with a lateral (horizontal) direction. A left end of the shell (20) in FIG. 1 is a first end (20*a*), and a right end thereof in FIG. 1 is a second end (20*b*).

A refrigerant outlet (22) for emitting the refrigerant out of the internal space (21) of the shell (20) is provided at the top of the shell (20). The refrigerant outlet (22) is formed closer to the second end (20*b*) of the shell (20). The refrigerant outlet (22) is connected to a compressor of the refrigeration apparatus via a pipe.

A refrigerant inlet (32) for introducing the refrigerant into the internal space (21) of the shell (20) is provided at the bottom of the shell (20). The refrigerant inlet (32) is formed at a center portion in the longitudinal direction of the shell (20). The refrigerant inlet (32) is connected to an expansion mechanism of the refrigeration apparatus via a pipe.

The shell (20) is provided with a heating medium inlet (23) and a heating medium outlet (24). The heating medium inlet (23) and the heating medium outlet (24) are tubular members. The heating medium inlet (23) penetrates the first end (20*a*) of the shell (20) and is connected to the plate stack (40) to introduce the heating medium to the plate stack (40). The heating medium outlet (24) penetrates the second end (20*b*) of the shell (20) and is connected to the plate stack (40) to emit the heating medium out of the plate stack (40).

—Plate Stack—

As illustrated in FIG. 1, the plate stack (40) includes a plurality of heat transfer plates (50*a*, 50*b*) stacked together. The plate stack (40) is housed in the internal space (21) of the shell (20) so that the stacking direction of the heat transfer plates (50*a*, 50*b*) coincides with the lateral direction.

The plate stack (40) is divided into a first heat exchange section (45*a*) and a second heat exchange section (45*b*) arranged side by side in the stacking direction of the heat transfer plates (50*a*, 50*b*).

Figure 2:
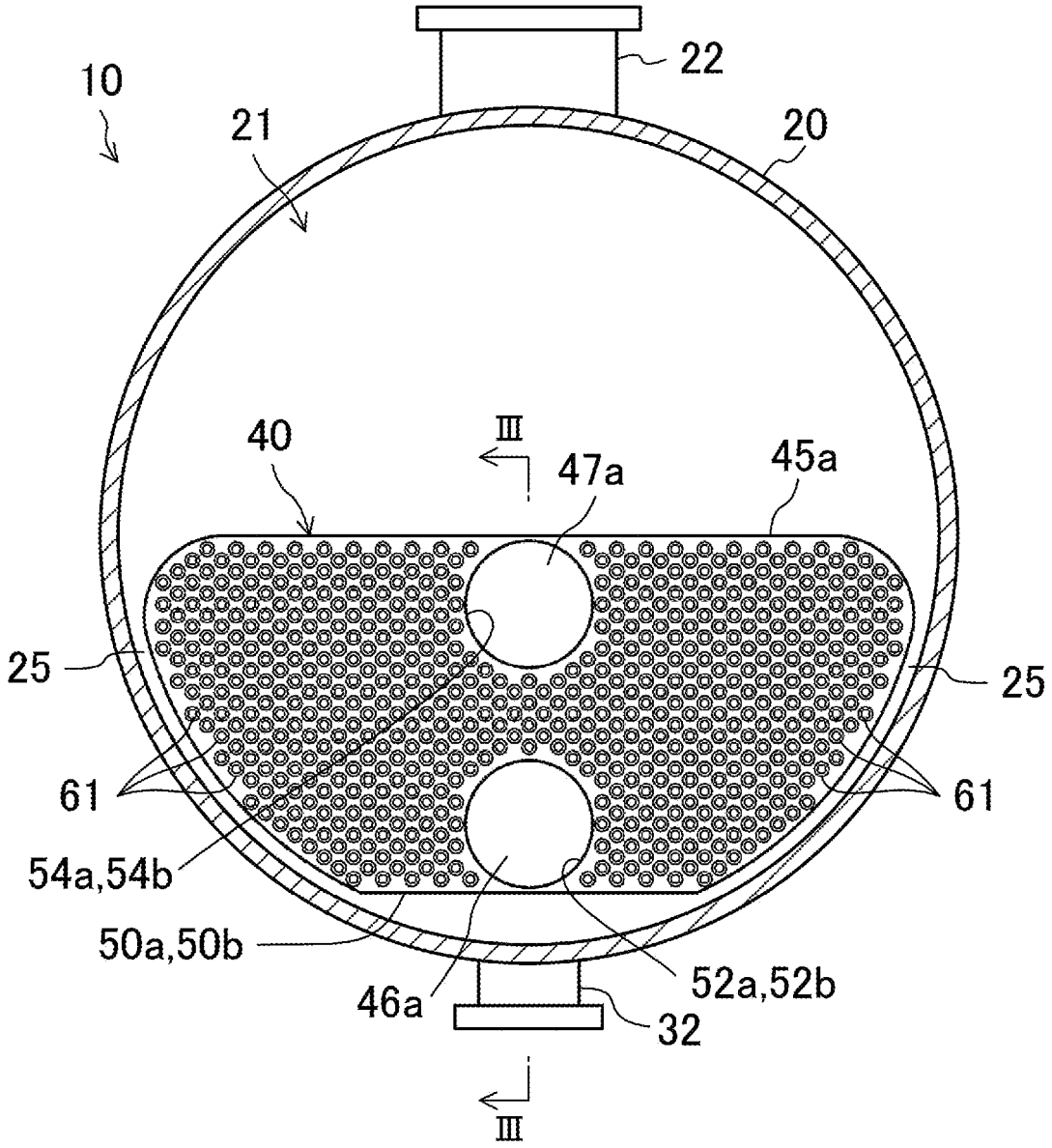
FIG. 2 is a cross-sectional view of the shell-and-plate heat exchanger taken along line II-II in FIG. 1.

As illustrated in FIG. 2, the heat transfer plates (50*a*, 50*b*) constituting the plate stack (40) are substantially semicircular plate-shaped members. The plate stack (40) is arranged near the bottom of the internal space (21) of the shell (20) with arc-shaped edges of the heat transfer plates (50*a*, 50*b*) facing downward.

Although not shown, supports in the shape of protrusions for supporting the plate stack (40) protrude from the inner surface of the shell (20). The plate stack (40) housed in the internal space (21) of the shell (20) is spaced apart from the inner surface of the shell (20), and forms a gap (25) between the downward edges of the heat transfer plates (50*a*, 50*b*) of the plate stack (40) and the inner surface of the shell (20).

Figure 3:
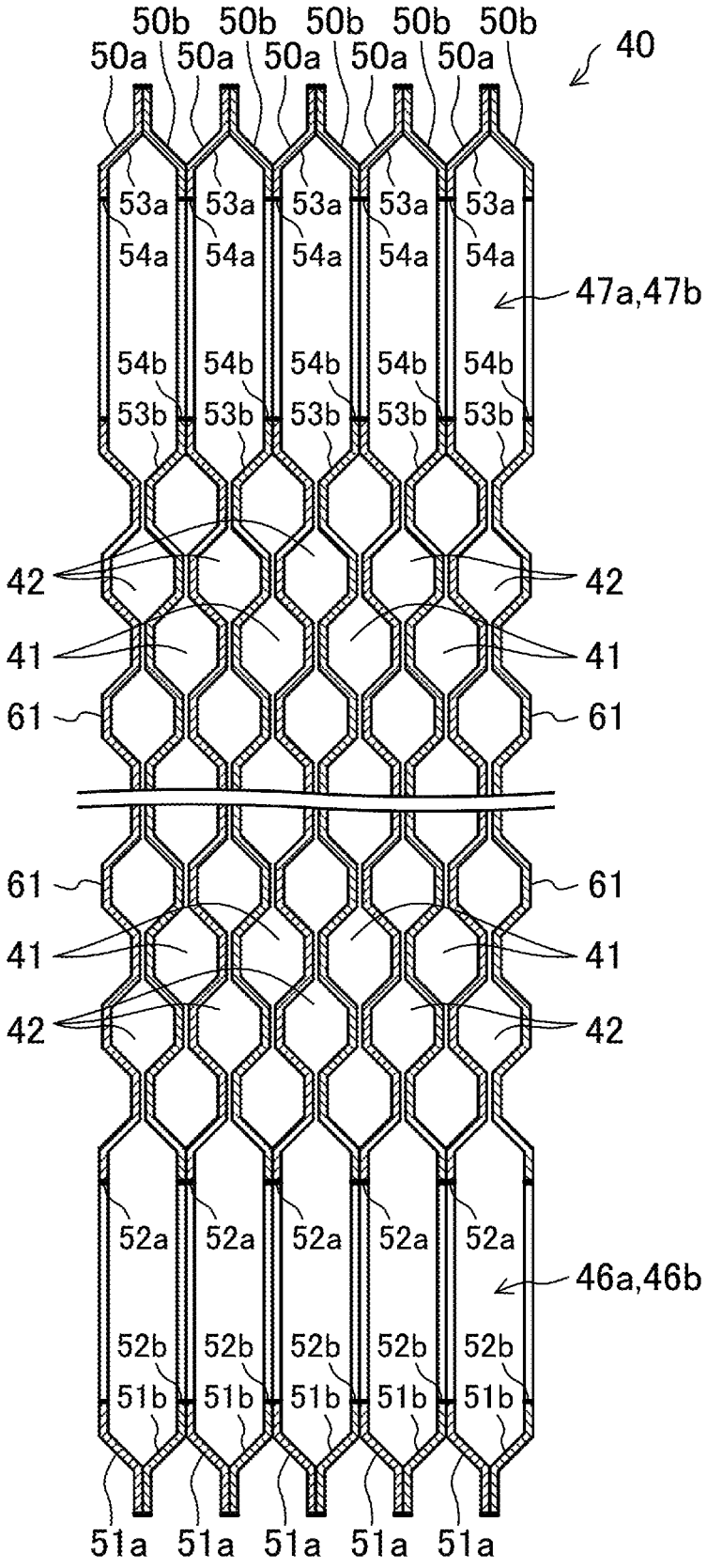
FIG. 3 is a cross-sectional view of a plate stack taken along line in FIG. 2.

As illustrated in FIG. 3, the plate stack (40) includes first plates (50*a*) and second plates (50*b*) having different shapes as the heat transfer plates. The plate stack (40) includes a plurality of first plates (50*a*) and a plurality of second plates (50*b*). The first plates (50*a*) and the second plates (50*b*) are alternately stacked to form the plate stack (40). In the following description, for each of the first plates (50*a*) and the second plates (50*b*), a surface on the left in FIG. 3 will be referred to as a front surface, and a surface on the right in FIG. 3 will be referred to as a back surface.

<First Heat Exchange Section and Second Heat Exchange Section>

As illustrated in FIG. 1, the plate stack (40) is divided into the first heat exchange section (45*a*) and the second heat exchange section (45*b*). Each of the first heat exchange section (45*a*) and the second heat exchange section (45*b*) includes a plurality of stacked heat transfer plates (50*a*, 50*b*). In the plate stack (40) of one or more embodiments, the first heat exchange section (45*a*) and the second heat exchange section (45*b*) include the same number of heat transfer plates (50*a*, 50*b*). The first heat exchange section (45*a*) is arranged closer to the first end (20*a*) of the shell (20). The second heat exchange section (45*b*) is arranged closer to the second end (20*b*) of the shell (20).

As will be described in detail later, the first heat exchange section (45*a*) includes a first lower communication passage (46*a*) and a first upper communication passage (47*a*), and the second heat exchange section (45*b*) includes a second lower communication passage (46*b*) and a second upper communication passage (47*b*). The heating medium inlet (23) is connected to the first upper communication passage (47*a*) of the first heat exchange section (45*a*). The second lower communication passage (46*b*) of the second heat exchange section (45*b*) is connected to the first lower communication passage (46*a*) of the first heat exchange section (45*a*). The heating medium outlet (24) is connected to the second upper communication passage (47*b*) of the second heat exchange section (45*b*).

The first heat exchange section (45*a*) and the second heat exchange section (45*b*) are arranged in series in a flow path of the heating medium in the plate stack (40). The second heat exchange section (45*b*) is arranged downstream of the first heat exchange section (45*a*) in the flow path of the heating medium in the plate stack (40). Thus, in the plate stack (40) of one or more embodiments, the first heat exchange section (45*a*) is the most upstream heat exchange section, and the second heat exchange section (45*b*) is the most downstream heat exchange section.

As described above, the second heat exchange section (45*b*) is arranged near the second end (20*b*) of the shell (20). Thus, in the heat exchanger (10) of one or more embodiments, the second heat exchange section (45*b*), which is the most downstream heat exchange section, is arranged closest to the refrigerant outlet (22) among the heat exchange sections (45*a*, 45*b*) of the plate stack (40). In the heat exchanger (10) of one or more embodiments, the first heat exchange section (45*a*), which is the most upstream heat exchange section, is arranged farthest from the refrigerant outlet (22) among the heat exchange sections (45*a*, 45*b*) of the plate stack (40).

<Refrigerant Channel and Heating Medium Channel>

As illustrated in FIG. 3, each of the first heat exchange section (45*a*) and second heat exchange section (45*b*) of the plate stack (40) includes refrigerant channels (41) and heating medium channels (42). Each of the heating medium channels (42) is adjacent to an associated one of the refrigerant channels (41) with the heat transfer plate (50*a*, 50*b*) interposed therebetween. The heat transfer plate (50*a*, 50*b*) separates the refrigerant channel (41) from the corresponding heating medium channel (42).

Each of the refrigerant channels (41) is a channel sandwiched between the front surface of the first plate (50*a*) and the back surface of the second plate (50*b*). The refrigerant channel (41) communicates with the internal space (21) of the shell (20). Each of the heating medium channels (42) is a channel sandwiched between the back surface of the first plate (50*a*) and the front surface of the second plate (50*b*). The heating medium channel (42) is blocked from the internal space (21) of the shell (20), and communicates with the heating medium inlet (23) and the heating medium outlet (24) attached to the shell (20).

<Dimples>

As illustrated in FIGS. 2 and 3, each of the first plates (50*a*) and the second plates (50*b*) has multiple dimples (61). The dimples (61) of the first plate (50*a*) bulge toward the front side of the first plate (50*a*). The dimples (61) of the second plate (50*b*) bulge toward the back side of the second plate (50*b*).

<Lower Communication Passage and Upper Communication Passage>

Each of the first plates (50*a*) has a lower protrusion (51*a*) and an upper protrusion (53*a*). Each of the lower protrusion (51*a*) and the upper protrusion (53*a*) is a circular portion bulging toward the front side of the first plate (50*a*). Each of the lower protrusion (51*a*) and the upper protrusion (53*a*) is formed in a widthwise center portion of the first plate (50*a*). The lower protrusion (51*a*) is formed in a lower portion of the first plate (50*a*). The upper protrusion (53*a*) is formed in an upper portion of the first plate (50*a*). A first lower hole (52*a*) is formed in a center portion of the lower protrusion (51*a*). A first upper hole (54*a*) is formed in a center portion of the upper protrusion (53*a*). Each of the first lower hole (52*a*) and the first upper hole (54*a*) is a circular hole penetrating the first plate (50*a*) in a thickness direction.

Each of the second plates (50*b*) has a lower recess (51*b*) and an upper recess (53*b*). Each of the lower recess (51*b*) and the upper recess (53*b*) is a circular portion bulging toward the back side of the second plate (50*b*). Each of the lower recess (51*b*) and the upper recess (53*b*) is formed in a widthwise center portion of the second plate (50*b*). The lower recess (51*b*) is formed in a lower portion of the second plate (50*b*). The upper recess (53*b*) is formed in an upper portion of the second plate (50*b*). A second lower hole (52*b*) is formed in a center portion of the lower recess (51*b*). A second upper hole (54*b*) is formed in a center portion of the upper recess (53*b*). Each of the second lower hole (52*b*) and the second upper hole (54*b*) is a circular hole penetrating the second plate (50*b*) in a thickness direction.

The second plate (50*b*) has the lower recess (51*b*) formed at a position corresponding to the lower protrusion (51*a*) of the first plate (50*a*), and the upper recess (53*b*) formed at a position corresponding to the upper protrusion (53*a*) of the first plate (50*a*). The second plate (50*b*) has the second lower hole (52*b*) formed at a position corresponding to the first lower hole (52*a*) of the first plate (50*a*), and the second upper hole (54*b*) formed at a position corresponding to the first upper hole (54*a*) of the first plate (50*a*). The first lower hole (52*a*) and the second lower hole (52*b*) have a substantially equal diameter. The first upper hole (54*a*) and the second upper hole (54*b*) have a substantially equal diameter.

In the plate stack (40), each first plate (50*a*) and an adjacent one of the second plates (50*b*) on the back side of the first plate (50*a*) are welded together at their peripheral portions along the whole perimeter. The first lower hole (52*a*) of each first plate (50*a*) in the plate stack (40) overlaps the second lower hole (52*b*) of an adjacent one of the second plates (50*b*) on the front side of the first plate (50*a*), and the rims of the overlapping first lower hole (52*a*) and second lower hole (52*b*) are welded together along the whole perimeter. The first upper hole (54*a*) of each first plate (50*a*) in the plate stack (40) overlaps the second upper hole (54*b*) of an adjacent one of the second plates (50*b*) on the front side of the first plate (50*a*), and the rims of the overlapping first upper hole (54*a*) and second upper hole (54*b*) are welded together along the whole perimeter.

In the plate stack (40), the lower protrusions (51*a*) and first lower holes (52*a*) of the first plates (50*a*) and the lower recesses (51*b*) and second lower holes (52*b*) of the second plates (50*b*) form the lower communication passages (46*a*, 46*b*). The upper protrusions (53*a*) and first upper holes (54*a*) of the first plates (50*a*) and the upper recesses (53*b*) and second upper holes (54*b*) of the second plates (50*b*) form the upper communication passages (47*a*, 47*b*) in the plate stack (40).

The lower communication passages (46*a*, 46*b*) and the upper communication passages (47*a*, 47*b*) are passages extending in the stacking direction of the heat transfer plates (50*a*, 50*b*) in the plate stack (40). The lower communication passages (46*a*, 46*b*) and the upper communication passages (47*a*, 47*b*) are passages blocked from the internal space (21) of the shell (20).

The first upper communication passage (47*a*) of the first heat exchange section (45*a*) communicates with all the heating medium channels (42) formed in the first heat exchange section (45*a*) and is connected to the heating medium inlet (23). The first lower communication passage (46*a*) of the first heat exchange section (45*a*) communicates with all the heating medium channels (42) formed in the first heat exchange section (45*a*) and is connected to the second lower communication passage (46*b*) of the second heat exchange section (45*b*). The second lower communication passage (46*b*) of the second heat exchange section (45*b*) communicates with all the heating medium channels (42) formed in the second heat exchange section (45*b*). The second upper communication passage (47*b*) of the second heat exchange section (45*b*) communicates with all the heating medium channels (42) formed in the second heat exchange section (45*b*) and is connected to the heating medium outlet (24).

—Flows of Refrigerant and Heating Medium in Heat Exchanger—

Flows of the refrigerant and the heating medium in the heat exchanger (10) of one or more embodiments will be described below.

<Flow of Heating Medium>

As illustrated in FIG. 1, the heating medium supplied to the heat exchanger (10) flows into the first upper communication passage (47*a*) of the first heat exchange section (45*a*) through the heating medium inlet (23), and is distributed to the heating medium channels (42) in the first heat exchange section (45*a*). The heating medium that has flowed into each heating medium channel (42) of the first heat exchange section (45*a*) flows generally downward while spreading in the width direction of the heat transfer plates (50*a*, 50*b*). The heating medium flowing in the heating medium channels (42) dissipates heat to the refrigerant flowing in the refrigerant channels (41). This lowers the temperature of the heating medium.

The heating medium cooled while flowing through each heating medium channel (42) of the first heat exchange section (45*a*) flows into the first lower communication passage (46*a*), and merges with the flows of the heating medium that have passed through the other heating medium channels (42). Thereafter, the heating medium flows into the second lower communication passage (46*b*) of the second heat exchange section (45*b*), and is distributed to the heating medium channels (42) in the second heat exchange section (45*b*). Thus, the heating medium cooled in the first heat exchange section (45*a*) flows into each of the heating medium channels (42) in the second heat exchange section (45*b*).

The heating medium that has flowed into each heating medium channel (42) of the second heat exchange section (45*b*) flows generally upward while spreading in the width direction of the heat transfer plates (50*a*, 50*b*). The heating medium flowing in the heating medium channels (42) dissipates heat to the refrigerant flowing in the refrigerant channels (41). This further lowers the temperature of the heating medium.

The heating medium cooled while flowing through each heating medium channel (42) of the second heat exchange section (45*b*) flows into the second upper communication passage (47*b*), and merges with the flows of the heating medium that have passed through the other heating medium channels (42). Thereafter, the heating medium in the second upper communication passage (47*b*) flows out of the heat exchanger (10) through the heating medium outlet (24), and is used for purposes such as air conditioning.

<Flow of Refrigerant>

The heat exchanger (10) receives a low-pressure refrigerant in a gas-liquid two phase that has passed through the expansion mechanism of the refrigerant circuit. The refrigerant supplied to the heat exchanger (10) flows into the internal space (21) of the shell (20) through the refrigerant inlet (32). The internal space (21) of the shell (20) contains the liquid refrigerant collected in a substantially lower portion thereof. Most part of the plate stack (40) is immersed in the liquid refrigerant in the shell (20). In the plate stack (40), the liquid refrigerant filling the refrigerant channels (41) is heated by the heating medium in the heating medium channels (42) to evaporate.

The gas refrigerant generated in the refrigerant channels (41) flows upward in the refrigerant channels (41) and flows into the space above the plate stack (40). Part of the gas refrigerant generated in the refrigerant channels (41) flows laterally into the gap (25) between the plate stack (40) and the shell (20), and flows into the space above the plate stack (40) through the gap (25). The refrigerant that has flowed into the space above the plate stack (40) flows out of the shell (20) through the refrigerant outlet (22). The refrigerant flowed out of the shell (20) is sucked into the compressor of the refrigeration apparatus.

—Amount of Liquid Refrigerant Flowing Out of Shell—

In the first heat exchange section (45*a*) of the plate stack (40), the heating medium coming through the heating medium inlet (23) exchanges heat with the refrigerant. In the second heat exchange section (45*b*) of the plate stack (40), the heating medium cooled in the first heat exchange section (45*a*) exchanges heat with the refrigerant. Thus, the temperature difference between the refrigerant and the heating medium that exchange heat with each other in the second heat exchange section (45*b*) is smaller than the temperature difference between the refrigerant and the heating medium that exchange heat with each other in the first heat exchange section (45*a*).

With the decrease in the temperature difference between the refrigerant and the heating medium that exchange heat with each other, the amount of heat that the refrigerant absorbs from the heating medium decreases. Thus, the amount of heat that the refrigerant absorbs from the heating medium in the second heat exchange section (45*b*) is smaller than the amount of heat that the refrigerant absorbs from the heating medium in the first heat exchange section (45*a*). For this reason, the second heat exchange section (45*b*) is a specific heat exchange section that provides the smallest amount of heat exchange among the heat exchange sections (45*a*, 45*b*) of the plate stack (40).

With the decrease in the temperature difference between the refrigerant and the heating medium that exchange heat with each other, the amount of heat that the refrigerant absorbs from the heating medium decreases, and the amount of gas refrigerant generated decreases. Thus, in the plate stack (40) of one or more embodiments, the second heat exchange section (45*b*) generates the smaller amount of gas refrigerant than the first heat exchange section (45*a*). As a result, the flow velocity of the refrigerant flowing upward from the second heat exchange section (45*b*) is lower than the flow velocity of the refrigerant flowing upward from the first heat exchange section (45*a*).

The refrigerant flowing into the space above the plate stack (40) contains a liquid refrigerant in the form of fine drops. With the decrease in the flow velocity of the gas refrigerant flowing upward from the plate stack (40), the amount of liquid refrigerant drops reaching the refrigerant outlet (22) together with the gas refrigerant decreases.

In the heat exchanger (10) of one or more embodiments, the second heat exchange section (45*b*) from which the gas refrigerant flows upward at the lowest flow velocity is arranged closest to the refrigerant outlet (22) among the heat exchange sections (45*a*, 45*b*) of the plate stack (40). Thus, the flow velocity of the gas refrigerant near the refrigerant outlet (22) is kept low, and the amount of the liquid refrigerant drops flowing out of the shell (20) through the refrigerant outlet (22) together with the gas refrigerant is kept low.

—Feature (1) of Embodiments—

In the heat exchanger (10) of one or more embodiments, the plate stack (40) is divided into a plurality of heat exchange sections (45*a*, 45*b*). Each of the plurality of heat exchange sections (45*a*, 45*b*) has two or more of the heat transfer plates (50*a*, 50*b*). The specific heat exchange section (45*b*), which is the heat exchange section that provides the smallest amount of heat exchange among the plurality of heat exchange sections (45*a*, 45*b*), is arranged closest to the refrigerant outlet (22) among the heat exchange sections (45*a*, 45*b*).

The specific heat exchange section (45*b*) generates the smallest amount of gas refrigerant among the heat exchange sections (45*a*, 45*b*). Thus, the flow velocity of the gas refrigerant flowing upward from the specific heat exchange section (45*b*) is the lowest among the flow velocities of the gas refrigerant flowing upward from the heat exchange sections (45*a*, 45*b*). The lower the flow velocity of the gas refrigerant flowing upward from the plate stack (40) is, the smaller the amount of liquid refrigerant in the shape of drops contained in the gas refrigerant is.

In the heat exchanger (10) of one or more embodiments, the specific heat exchange section (45*b*) in which the gas refrigerant flows upward at the lowest flow velocity is arranged closest to the refrigerant outlet (22) among the heat exchange sections (45*a*, 45*b*). This reduces the amount of liquid refrigerant flowing out of the shell (20) together with the gas refrigerant, improving the performance of the heat exchanger (10).

—Feature (2) of Embodiments—

In the plate stack (40) of one or more embodiments, the plurality of heat exchange sections (45*a*, 45*b*) are arranged in series in the flow path of the heating medium. The most downstream heat exchange section (45*b*), which is the most downstream one of the heat exchange sections in the flow path of the heating medium, constitutes the specific heat exchange section.

In the plate stack (40) of one or more embodiments, the heating medium is cooled while passing through the plurality of heat exchange sections (45*a*, 45*b*) in order. The temperature of the heating medium flowing into the most downstream heat exchange section (45*b*) is the lowest among the temperatures of the heating medium flowing into the heat exchange sections (45*a*, 45*b*). Thus, the temperature difference between the heating medium and the refrigerant that exchange heat in the most downstream heat exchange section (45*b*) is the smallest among the temperature differences between the heating medium and the refrigerant that exchange heat in the heat exchange sections (45*a*, 45*b*). In the heat exchanger (10) of one or more embodiments, the most downstream heat exchange section (45*b*) constitutes the specific heat exchange section.

—Feature (3) of Embodiments—

In the heat exchanger (10) of one or more embodiments, the most upstream heat exchange section (45*a*), which is the most upstream one of the heat exchange sections in the flow path of the heating medium, is arranged farthest from the refrigerant outlet (22) among the heat exchange sections (45*a*, 45*b*) of the plate stack (40).

The temperature of the heating medium flowing into the most upstream heat exchange section (45*a*) is the highest among the temperatures of the heating medium flowing into the heat exchange sections (45*a*, 45*b*). Thus, the temperature difference between the heating medium and the refrigerant that exchange heat in the most upstream heat exchange section (45*a*) is the greatest among the temperature differences between the heating medium and the refrigerant that exchange heat in the heat exchange sections (45*a*, 45*b*). The amount of gas refrigerant generated increases with the increase in the temperature difference between the heating medium and the refrigerant that exchange heat with each other.

In the heat exchanger (10) of one or more embodiments, the most upstream heat exchange section (45*a*) in which the amount of gas refrigerant generated is larger than that in the other heat exchange sections (45*b*, 45*a*) is arranged farthest from the refrigerant outlet (22) among the heat exchange sections (45*a*, 45*b*). The amount of liquid refrigerant in the shape of drops contained in the gas refrigerant that reaches the refrigerant outlet (22) decreases with the increase in the distance from the heat exchange section (45*a*, 45*b*) to the refrigerant outlet (22). Thus, in one or more embodiments, the most upstream heat exchange section (45*a*) is located away from the refrigerant outlet (22), thereby making it possible to reduce the amount of liquid refrigerant flowing out of the shell (20) together with the gas refrigerant.

—Feature (4) of Embodiments—

The plate stack (40) of one or more embodiments is configured to allow the heating medium to flow in the up-down direction in the heating medium channels (42). The heating medium flows downward in the heating medium channels (42) of the most upstream heat exchange section (45*a*). The heating medium flows upward in the heating medium channels (42) of the most downstream heat exchange section (45*b*).

In the most upstream heat exchange section (45*a*) of one or more embodiments, the heating medium flowing downward exchanges heat with the refrigerant. In the most downstream heat exchange section (45*b*), the heating medium flowing upward exchanges heat with the refrigerant.

—Feature (5) of Embodiments—

The plate stack (40) of one or more embodiments is divided into the first heat exchange section (45*a*) and the second heat exchange section (45*b*). In the plate stack (40), the second heat exchange section (45*b*) is arranged downstream of the first heat exchange section (45*a*) in the flow path of the heating medium. The ratio (N1/N2) of the number N1 of heat transfer plates (50*a*, 50*b*) in the first heat exchange section (45*a*) to the number N2 of heat transfer plates (50*a*, 50*b*) in the second heat exchange section (45*b*) is "1" (N1/N2=1).

—Feature (6) of Embodiments—

In the heat exchanger (10) of one or more embodiments, the shell (20) is arranged so that its longitudinal direction coincides with the lateral direction. One end of the shell (20) in the longitudinal direction is the first end (20*a*), and the other end is the second end (20*b*). The refrigerant outlet (22) is arranged near the second end (20*b*) in the longitudinal direction of the shell (20). The plate stack (40) is placed with the stacking direction of the heat transfer plates (50*a*, 50*b*) extending in the longitudinal direction of the shell (20). The specific heat exchange section (45*b*) is provided at an end of the plate stack (40) near the second end (20*b*) of the shell (20).

Variations of Embodiments

The heat exchanger (10) of one or more embodiments may be modified in the following manner. The following variations may be combined or replaced without deteriorating the functions of the heat exchanger (10).

<First Variation>

Figure 4:
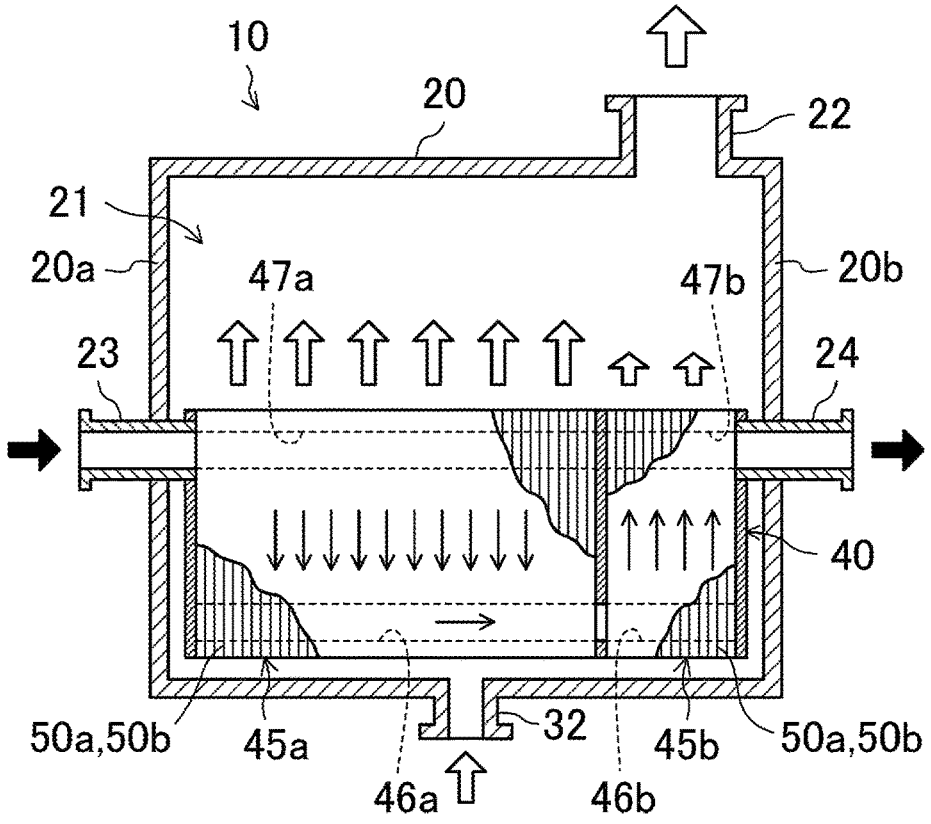
FIG. 4 is a cross-sectional view corresponding to FIG. 1, illustrating a shell-and-plate heat exchanger according to a first variation of one or more embodiments.

As illustrated in FIG. 4, in the plate stack (40) of one or more embodiments, "the number N1 of heat transfer plates (50*a*, 50*b*) forming the first heat exchange section (45*a*)" may be different from "the number N2 of heat transfer plates (50*a*, 50*b*) forming the second heat exchange section (45*b*)." Note that "the number N2 of heat transfer plates (50*a*, 50*b*) forming the second heat exchange section (45*b*)" is smaller than "the number N1 of heat transfer plates (50*a*, 50*b*) forming the first heat exchange section (45*a*)."

Specifically, in the plate stack (40) of one or more embodiments, the ratio (N1/N2) of "the number N1 of heat transfer plates (50*a*, 50*b*) forming the first heat exchange section (45*a*)" to "the number N2 of heat transfer plates (50*a*, 50*b*) forming the second heat exchange section (45*b*)" may be one or more and three or less (1<N1/N2<3). When the value of N1/N2 is set to one or more to three or less, the flow velocity of the gas refrigerant flowing upward from the second heat exchange section (45*b*) is reliably made lower than the flow velocity of the gas refrigerant flowing upward from the first heat exchange section (45*a*).

<Second Variation>

Figure 5:
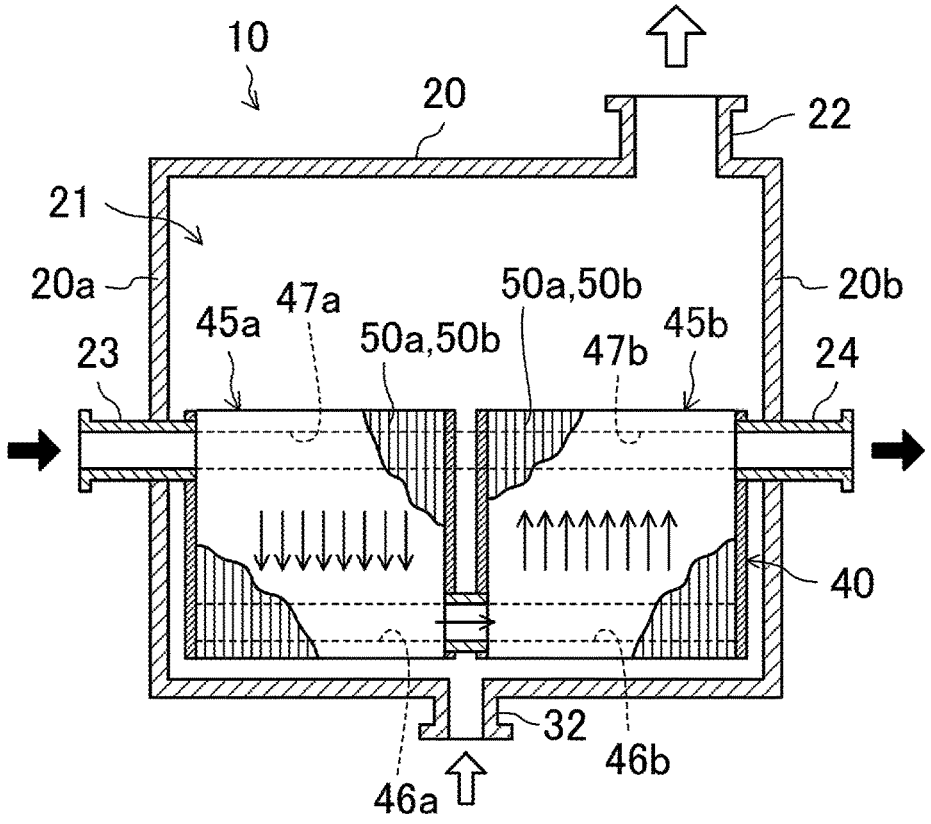
FIG. 5 is a cross-sectional view corresponding to FIG. 1, illustrating a shell-and-plate heat exchanger according to a second variation of one or more embodiments.

As illustrated in FIG. 5, the first heat exchange section (45*a*) and the second heat exchange section (45*b*) in the plate stack (40) of one or more embodiments may be separated from each other. In the plate stack (40) of this variation, the first lower communication passage (46*a*) of the first heat exchange section (45*a*) and the second lower communication passage (46*b*) of the second heat exchange section (45*b*) are connected to each other via a pipe.

<Third Variation>

Figure 6:
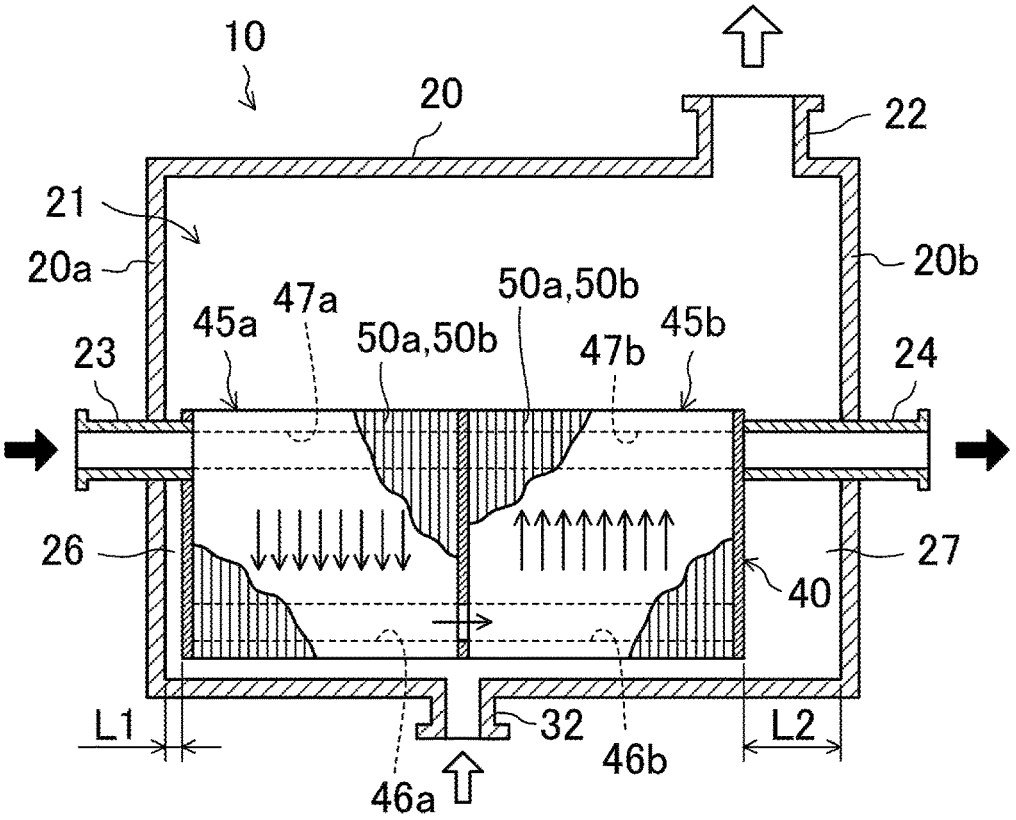
FIG. 6 is a cross-sectional view corresponding to FIG. 1, illustrating a shell-and-plate heat exchanger according to a third variation of one or more embodiments.

As illustrated in FIG. 6, in the heat exchanger (10) of one or more embodiments, the plate stack (40) may be arranged in the internal space (21) of the shell (20) to be close to the first end (20*a*) of the shell (20) in FIG. 6. In FIG. 6, a length L2 between an inner surface of the second end (20*b*) of the shell (20) and a right end surface of the second heat exchange section (45*b*) is greater than a length L1 between an inner surface of the first end (20*a*) of the shell (20) and a left end surface of the first heat exchange section (45*a*) (L1<L2).

In the heat exchanger (10) of this variation, a second space (27) formed between the second end (20*b*) of the shell (20) close to the refrigerant outlet (22) and the second heat exchange section (45*b*) is wider than a first space (26) formed between the first end (20*a*) of the shell (20) far from the refrigerant outlet (22) and the first heat exchange section (45*a*). In the heat exchanger (10) of this variation, the refrigerant outlet (22) is located to overlap the second space (27) when the heat exchanger (10) is viewed from above.

No gas refrigerant is generated in the second space (27). Thus, this variation can keep the flow velocity of the gas refrigerant reaching the refrigerant outlet (22) low, and thus, can reduce the amount of liquid refrigerant flowing out of the shell (20) together with the gas refrigerant.

<Fourth Variation>

Figure 7:
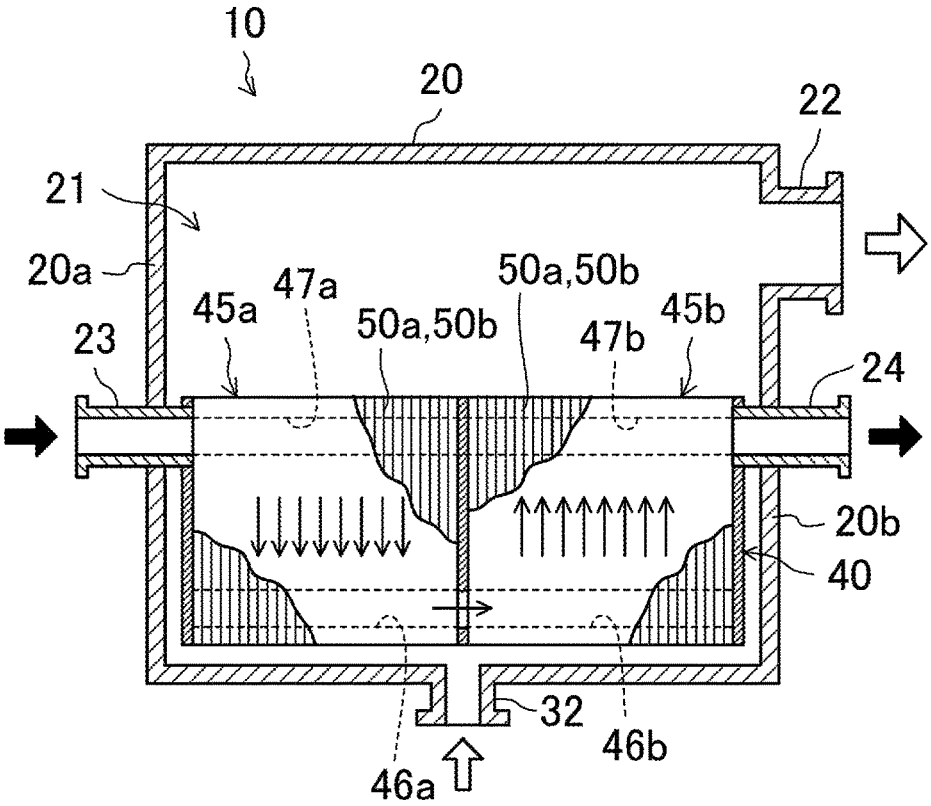
FIG. 7 is a cross-sectional view corresponding to FIG. 1, illustrating a shell-and-plate heat exchanger according to a fourth variation of one or more embodiments.

In the heat exchanger (10) of one or more embodiments, the refrigerant outlet (22) may be provided in an upper portion of the second end (20*b*) of the shell (20) as illustrated in FIG. 7.

<Fifth Variation>

Figure 8:
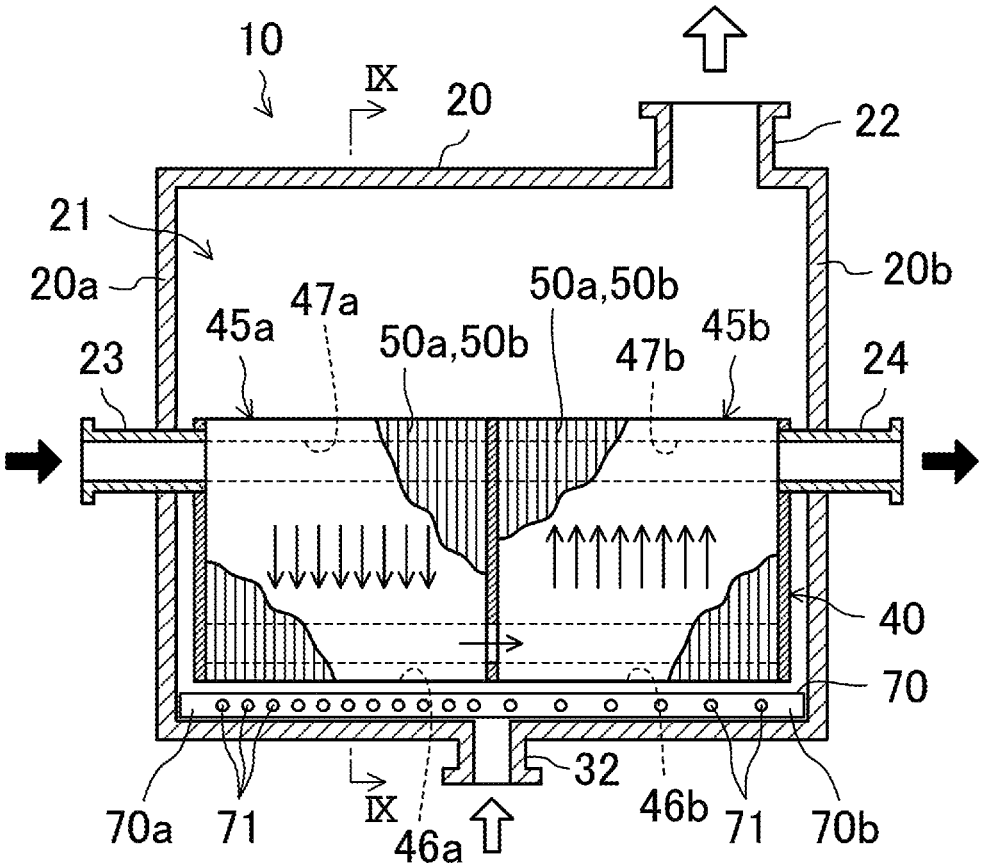
FIG. 8 is a cross-sectional view corresponding to FIG. 1, illustrating a shell-and-plate heat exchanger according to a fifth variation of one or more embodiments.
Figure 9:
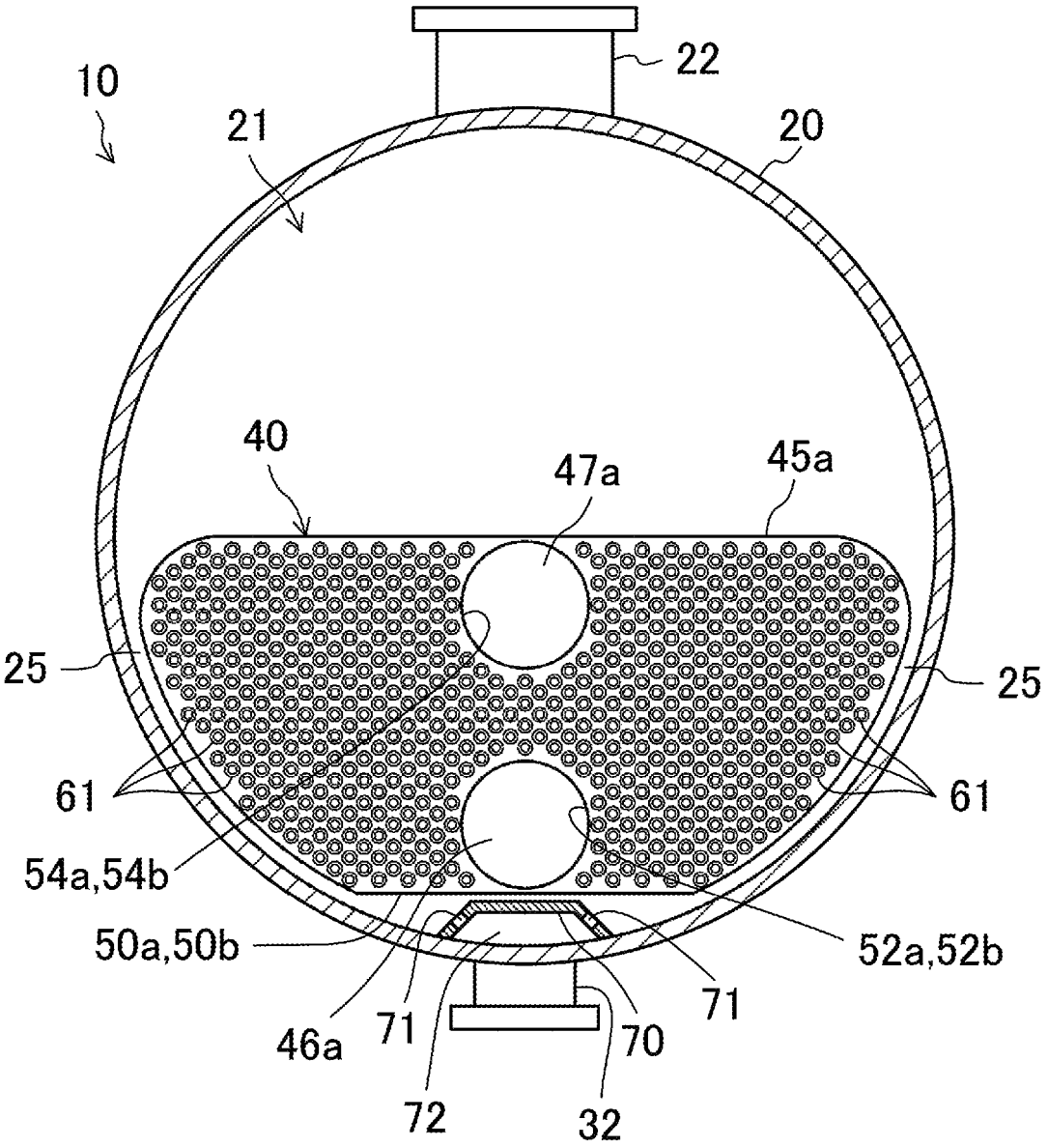
FIG. 9 is a cross-sectional view of the shell-and-plate heat exchanger taken along line IX-IX in FIG. 8.

As illustrated in FIGS. 8 and 9, the heat exchanger (10) of one or more embodiments may include a distribution plate (70).

The distribution plate (70) is a plate-shaped member covering an inner surface of the bottom of the shell (20), and forms a distribution chamber (72) between the distribution plate (70) and the bottom of the shell (20). The distribution plate (70) covers an opening end of the refrigerant inlet (32) on the inner surface of the shell (20). The distribution plate (70) is provided over the entire length of the internal space of the shell (20).

A plurality of outlets (71) are formed in inclined side portions of the distribution plate (70). Each of the outlets (71) is open through the distribution plate (70) in the thickness direction, and allows the distribution chamber (72) to communicate with the space outside the distribution plate (70). In each side portion of the distribution plate (70), the outlets (71) are arranged in a row at a predetermined pitch in the longitudinal direction of the distribution plate (70).

The distribution plate (70) has a first portion (70*a*) located below the first heat exchange section (45*a*) and a second portion (70*b*) located below the second heat exchange section (45*b*). The outlets (71) formed in the second portion (70*b*) are arranged at a wider pitch than the outlets (71) formed in the first portion (70*a*).

The refrigerant supplied to the refrigerant inlet (32) of the heat exchanger (10) flows into the distribution chamber (72) covered with the distribution plate (70), and flows out of the distribution chamber (72) through the outlets (71). As described above, the outlets (71) formed in the second portion (70*b*) are arranged at a wider pitch than the outlets (71) formed in the first portion (70*a*). The second portion (70*b*) has fewer outlets (71) than the first portion (70*a*). Thus, the refrigerant supplied to the second heat exchange section (45*b*) flows at a lower flow rate than the refrigerant supplied to the first heat exchange section (45*a*). This makes the amount of gas refrigerant generated in the second heat exchange section (45*b*) smaller than the amount of gas refrigerant generated in the first heat exchange section (45*a*).

<Sixth Variation>

In the heat exchanger (10) of one or more embodiments, the plate stack (40) may be divided into three or more heat exchange sections. In the plate stack (40) of this variation, the three or more heat exchange sections are also arranged in series in the flow path of the heating medium.

The plate stack (40) of this variation is placed in the internal space (21) of the shell (20) so that the heat exchange section located most upstream in the flow path of the heating medium (most upstream heat exchange section) is located farthest from the refrigerant outlet (22) of the shell (20), and that the heat exchange section located most downstream in the flow path of the heating medium (most downstream heat exchange section) is located closest to the refrigerant outlet (22) of the shell (20).

<Seventh Variation>

In the heat exchanger (10) of one or more embodiments, each of the heat transfer plates (50*a*, 50*b*) forming the plate stack (40) may be provided with a corrugated pattern including repeated narrow ridges and grooves instead of the dimples (61).

For example, the corrugated pattern formed on the heat transfer plate (50*a*, 50*b*) may have the ridge lines and groove lines extending in the width direction of the heat transfer plate (50*a*, 50*b*). Alternatively, the corrugated pattern formed on the heat transfer plate (50*a*, 50*b*) may be a herringbone pattern in which the ridges and grooves meander to the left and the right.

<Eighth Variation>

In the heat exchanger (10) of one or more embodiments, the shape of the heat transfer plates (50*a*, 50*b*) forming the plate stack (40) is not limited to the semicircular shape. For example, the heat transfer plates (50*a*, 50*b*) may have an elliptical shape or a circular shape.

While the embodiments and the variations thereof have been described above, it will be understood that various changes in form and details may be made without departing from the spirit and scope of the claims. The embodiments and the variations thereof may be combined and replaced with each other without deteriorating intended functions of the present disclosure. The ordinal numbers such as "first," "second," "third," . . . , in the description and claims are used to distinguish the terms to which these expressions are given, and do not limit the number and order of the terms.

As can be seen from the foregoing description, the present disclosure is useful for a shell-and-plate heat exchanger.

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

REFERENCE SIGNS LIST

10 Shell-and-Plate Heat Exchanger
20 Shell
20*a* First End
20*b* Second End
21 Internal Space
22 Refrigerant Outlet
40 Plate Stack
41 Refrigerant Channel
42 Heating Medium Channel
45*a* First Heat Exchange Section (Most Upstream Heat Exchange Section)
45*b* Second Heat Exchange Section (Most Downstream Heat Exchange Section, Specific Heat Exchange Section)
50*a* First Plate (Heat Transfer Plate)
50*b* Second Plate (Heat Transfer Plate)

What is claimed is:

1. A shell-and-plate heat exchanger comprising:
a shell that:
forms an internal space, and
comprises:
a refrigerant outlet at a top of the shell; and
a refrigerant inlet disposed at a bottom of the shell and that introduces a refrigerant into the internal space; and
a plate stack disposed in the internal space and that comprises heat transfer plates that are stacked and joined together, wherein
the shell-and-plate heat exchanger is configured to allow the refrigerant that has flowed into the internal space to evaporate,
the refrigerant outlet emits a gas refrigerant out of the internal space through the refrigerant outlet,
a stacking direction of the heat transfer plates is in a longitudinal direction of the shell,
the refrigerant inlet is disposed at a center portion in the longitudinal direction of the shell,
the plate stack forms:
refrigerant channels that communicate with the internal space and through which a refrigerant flows; and
heating medium channels that are blocked from the internal space and through which a heating medium flows,
each of the refrigerant channels is adjacent to an associated one of the heating medium channels with one of the heat transfer plates interposed therebetween,
the plate stack is divided into heat exchange sections each comprising two or more of the heat transfer plates,
one of the heat exchange sections that is disposed closest to the refrigerant outlet exchanges a smallest amount of heat among the heat exchange sections,
the heat exchange sections are disposed in series in a flow path of the heating medium in the plate stack,
the one of the heat exchange sections is constituted of a most downstream heat exchange section that is disposed most downstream in the flow path of the heating medium among the heat exchange sections, and a number of the heat transfer plates in the most downstream heat exchange section is equal to or smaller than a number of the heat transfer plates in any other of the heat exchange sections.

2. The shell-and-plate heat exchanger according to claim 1, wherein a most upstream heat exchange section that is disposed most upstream in the flow path of the heating medium among the heat exchange sections is disposed farthest from the refrigerant outlet among the heat exchange sections.

3. The shell-and-plate heat exchanger according to claim 2, wherein the plate stack is configured to allow the heating medium to flow in an up-down direction in the heating medium channels, the heating medium flows downward in the heating medium channels of the most upstream heat exchange section, and the heating medium flows upward in the heating medium channels of the most downstream heat exchange section.

4. The shell-and-plate heat exchanger according to claim 1, wherein the heat exchange sections include a first heat exchange section and a second heat exchange section, the second heat exchange section is disposed downstream of the first heat exchange section in the flow path of the heating medium in the plate stack, the second heat exchange section is the most downstream heat exchanger section, and a ratio of a number of the heat transfer plates in the first heat exchange section to a number of the heat transfer plates in the second heat exchange section is one or more and three or less.

5. The shell-and-plate heat exchanger according to claim 1, wherein the shell is disposed such that a longitudinal direction of the shell coincides with a lateral direction of the shell, the shell has a first end and a second end in the longitudinal direction, the refrigerant outlet is disposed closer to the second end than to the first end, and the one of the heat exchange sections is disposed at an end of the plate stack closer to the second end than to the first end.

* * * * *